US006837164B1

(12) United States Patent
Khanna et al.

(10) Patent No.: US 6,837,164 B1
(45) Date of Patent: Jan. 4, 2005

(54) PROPELLING CHARGE INCREMENT PROTECTOR FOR 120MM MORTAR AMMUNITION

(75) Inventors: Vishwa Khanna, Randolph, NJ (US); Richard C Dzury, Dover, NJ (US); Kenneth Milano, Bayonne, NJ (US); Tapan Chatterjee, Succasunna, NJ (US)

(73) Assignee: The United States of America as represented by the Secretary of the Army, Washington, DC (US)

( * ) Notice: Subject to any disclaimer, the term of this patent is extended or adjusted under 35 U.S.C. 154(b) by 129 days.

(21) Appl. No.: 10/248,974

(22) Filed: Mar. 6, 2003

Related U.S. Application Data

(60) Provisional application No. 60/319,692, filed on Nov. 13, 2002.

(51) Int. Cl.[7] ..... F42B 30/12

(52) U.S. Cl. ..... 102/373; 102/283; 102/285; 102/288; 102/291; 102/293; 102/372; 102/391; 206/3

(58) Field of Search ..... 102/373, 372, 102/391, 288, 283, 285, 291, 293; 206/3

(56) References Cited

U.S. PATENT DOCUMENTS

| | | | | | |
|---|---|---|---|---|---|
| 2,052,546 | A | * | 9/1936 | Brandt | 102/373 |
| 2,113,313 | A | * | 4/1938 | Brandt | 102/373 |
| 2,718,191 | A | * | 9/1955 | Garrahan | 102/373 |
| 3,124,070 | A | * | 3/1964 | Jasse | 102/373 |
| 3,710,997 | A | * | 1/1973 | Asikainen | 224/628 |
| 4,039,640 | A | * | 8/1977 | Leneveu | 264/3.3 |
| 4,248,342 | A | * | 2/1981 | King et al. | 206/3 |
| 4,631,154 | A | * | 12/1986 | O'Driscoll | 264/3.1 |
| 4,711,180 | A | * | 12/1987 | Smolnik | 102/445 |
| 4,809,848 | A | * | 3/1989 | Rozmestor | 206/303 |
| 5,353,709 | A | * | 10/1994 | Emmenegger et al. | 102/309 |

FOREIGN PATENT DOCUMENTS

| | | | |
|---|---|---|---|
| EP | 0002968 | * | 7/1979 |
| FI | 0034635 | * | 10/1965 |
| FR | 1295471 | * | 5/1962 |

* cited by examiner

*Primary Examiner*—Jack Keith
*Assistant Examiner*—John Richardson
(74) *Attorney, Agent, or Firm*—Michael C. Sachs; John F. Moran

(57) ABSTRACT

A protector for propelling charge increments on a mortar shell includes a semi-cylindrical body, the semi-cylindrical body arranged around a bottom and sides of the charge increments; two generally horseshoe shaped end plates attached to a front and a rear of the semi-cylindrical body, the end plates defining openings therein, the tail tube of the mortar fitting in the opening in each end plate, the charge increments being disposed between the two end plates; a wedge-shaped boom attached to the rear end plate, the wedge-shaped boom fitting between two fins on the fin portion of the mortar shell; a stop tab attached to a rear end of the wedge-shaped boom, the stop tab extending substantially perpendicular to a narrow side of the wedge-shaped boom to contact an end of the fin portion thereby minimizing longitudinal motion of the charge increments; and a nose cone attached at the front of the semi-cylindrical body, the nose cone defining an opening at its front end, the middle portion of the mortar shell fitting in the opening.

7 Claims, 3 Drawing Sheets

PROPELLING CHARGE INCREMENT PROTECTOR FOR 120MM MORTAR AMMUNITION

CROSS REFERENCE TO RELATED APPLICATIONS

This application claims the benefit under 35 USC 119e of U.S. provisional patent application Ser. No. 60/319,692 filed on Nov. 13, 2002, which application is expressly incorporated by reference.

FEDERAL RESEARCH STATEMENT

The inventions described herein may be manufactured, used and licensed by or for the U.S. Government for U.S. Government purposes.

BACKGROUND OF INVENTION

The invention relates in general to mortar shells and in particular to a protector for propelling charge increments mounted on a mortar shell.

FIG. 1 is a side view of a known mortar shell 10. Mortar shell 10 includes a front portion 12, a middle portion 14, a tail tube 16 and a fin portion 18 comprising a plurality of fins 20. Middle portion 14 has a generally decreasing cross-section in the aft direction. Tail tube 16 is of substantially constant cross-section. FIG. 2 is an end view of a propelling charge increment 22. Increment 22 is generally horseshoe shaped with an opening 24. FIG. 3 is a side view of the aft portion of a mortar shell 10 with a plurality of propelling charge increments 22 mounted thereon. Increments 22 are mounted on the tail tube 16. The tail tube 16 fits into the opening 24 in each increment 22. Propelling charge increments 22 provide the propellant for launching the mortar shell 10 from a mortar gun tube.

Prior to launch, there is a need to protect the propelling charge increments 22 from damage during storage and transportation. A two-piece clam shell increment protector is known. Some disadvantages of the two-piece clam shell increment protector are warpage and the need for matching halves. The present invention is an increment protector made of polycarbonate/acrylonitrile butydiene styrene (PC/ABS) plastic alloy, which is stronger than the prior high-density polyethylene. The single molded piece of the invention eliminates warpage and the need for matching halves. The invention reduces material costs because there is less plastic material per protector and labor costs are reduced because the tape and taping operation used in the prior design are eliminated. The inventive protector is also easier to install and remove. Because the warning label is molded into the invention, the need to affix a label on the protector is eliminated.

The invention will be better understood, and further objects, features, and advantages thereof will become more apparent from the following description of the preferred embodiments, taken in conjunction with the accompanying drawings.

BRIEF DESCRIPTION OF DRAWINGS

In the drawings, which are not necessarily to scale, like or corresponding parts are denoted by like or corresponding reference numerals.

DETAILED DESCRIPTION

The invention is a propelling charge increment protector for a mortar shell, for example, a 120 mm mortar shell. The protector includes an injection-molded plastic part preferably made of a polycarbonate/acrylonitrile butydiene styrene (PC/ABS) plastic alloy and a foam insert made of polyethylene foam. The protector has many features that serve to protect the propelling charge increments, which are affixed to mortar shells during shipping, handling and firing.

Figure 1:
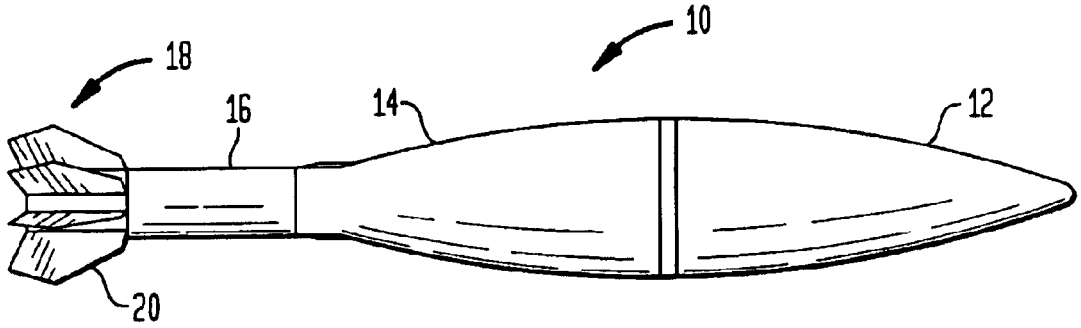
FIG. 1 (PRIOR ART)
FIG. 1 is a side view of a known mortar shell.
Figure 2:
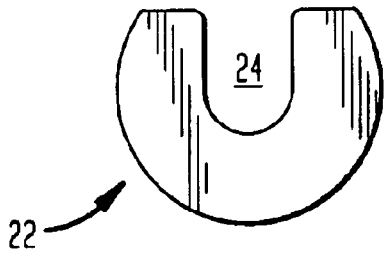
FIG. 2 (PRIOR ART)
FIG. 2 is an end view of a propelling charge increment.
Figure 3:
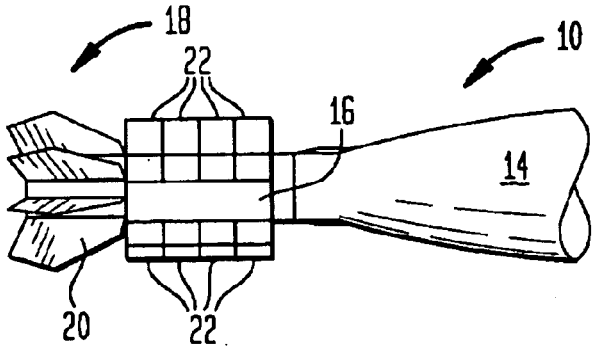
FIG. 3 (PRIOR ART)
FIG. 3 is a side view of the aft portion of a mortar shell.
Figure 4B:
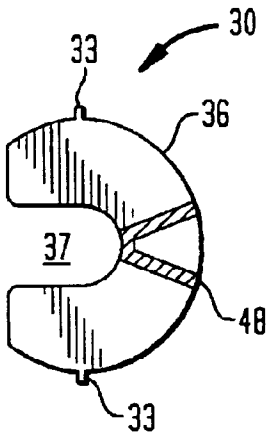
FIG. 4B is a sectional view along the line B—B of FIG. 4.
Figure 4:
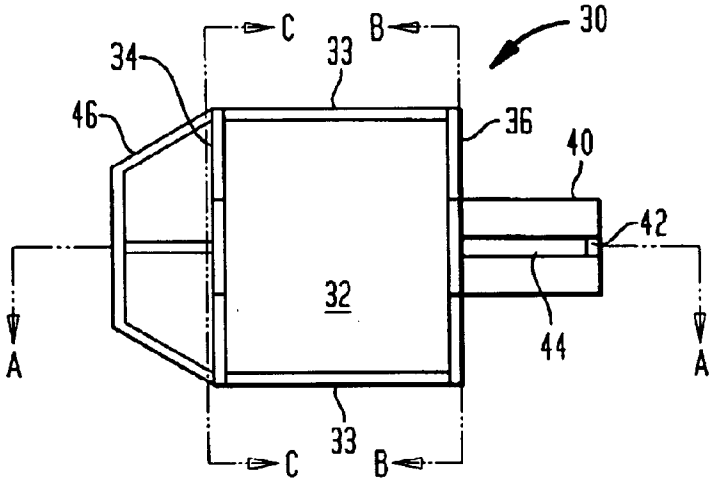
FIG. 4 is a bottom view of an increment protector according to the invention.
Figure 4A:
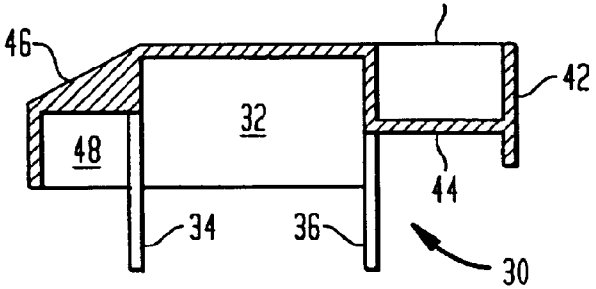
FIG. 4A is a sectional view along the line A—A of FIG. 4.
Figure 4C:
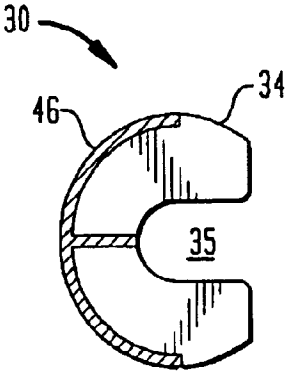
FIG. 4C is a sectional view along the line C—C of FIG. 4.

FIG. 4 is a bottom view of an increment protector 30 according to the invention. FIG. 4A is a sectional view along the line A—A of FIG. 4. FIG. 4B is a sectional view along the line B—B of FIG. 4. FIG. 4C is a sectional view along the line C—C of FIG. 4. Protector 30 includes a semi-cylindrical body 32 and front and rear generally horseshoe shaped end plates 34, 36 attached to the front and rear of the semi-cylindrical body, respectively. The end plates 34, 36 define openings 35, 37 therein. A wedge-shaped boom 40 is attached to the rear end plate 36. A stop tab 42 is attached to the rear end of the wedge-shaped boom 40. The stop tab 42 extends substantially perpendicular to the narrow side 44 of the wedge-shaped boom 40. A nose cone 46 is attached at the front of the semi-cylindrical body 32. The nose cone 46 defines an opening 48 at its front end.

Figure 5:
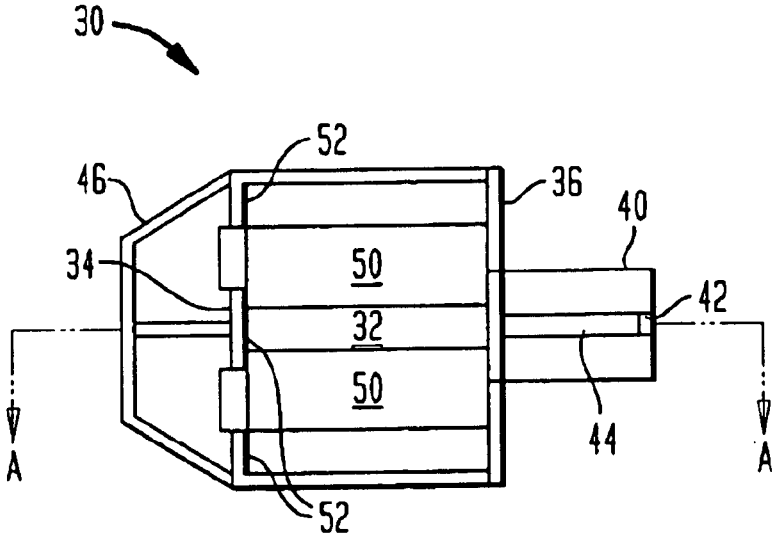
FIG. 5 is a bottom view of an increment protector according to the invention.
Figure 5A:
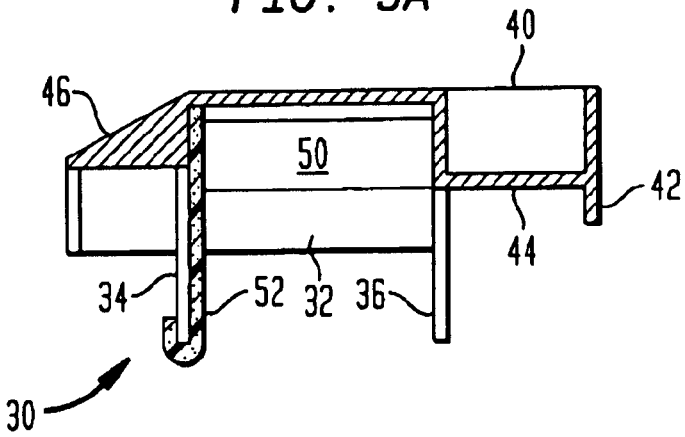
FIG. 5A is a sectional view along the line A—A of FIG. 5.
Figure 6A:
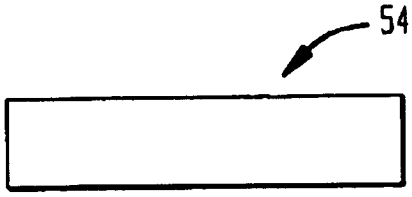
FIG. 6A is a top view of a foam insert.
Figure 6B:
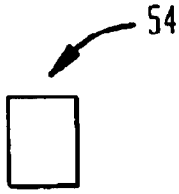
FIG. 6B is an end view of a foam insert.

FIG. 5 is a bottom view of the increment protector 30 shown in FIG. 4, with some additional features. FIG. 5A is a sectional view along the line A—A of FIG. 5. At least a portion of the interior of the semi-cylindrical body 32 is covered with foam, preferably polyether polyurethane foam. Rectangular strips 50 are shown in FIGS. 5 and 5A. Strips 50 may be, for example, glued to body 32. Another piece of foam 52 covers the interior of front end plate 34 and overlaps onto the exterior of front end plate 34, as shown in FIG. 5A. FIG. 6A is a top view of a foam insert 54. FIG. 6B is an end view of a foam insert 54. The foam insert is preferably made of polyether polyurethane foam and is preferably in the shape of a regular prism. The foam insert is placed in the open ends of the charge increments 22 to retain the increments inside the protector 30.

The semi-cylindrical body 32 is arranged around the bottom and sides of the charge increments 22 to protect the increments 22. The edges 33 of the semi-cylindrical body 32 are chamfered to prevent the edges 33 from damaging the increments 22. The tail tube 16 of the mortar shell 10 fits in the openings 35, 37 in the two generally horseshoe shaped end plates 34, 36. The charge increments 22 are located between the two end plates 34, 36. End plates 34, 36 protect the sides of the propelling charge increments 22 and prevent them from bending and being damaged during rough handling environments. The wedge-shaped boom 40 fits between two fins 20 on the fin portion 18 of the mortar shell 10. The wedge-shaped boom 40 stabilizes the protector 30 and the charge increments 22. The stop tab 42 contacts the end of the fin portion 18 to thereby minimize longitudinal motion of the charge increments 22. The middle portion 14 of the mortar shell 10 fits in the opening 48 at the front end of the nose cone 46.

Foam pieces 50, 52 help secure the propelling charge increments 22 in the increment protector 30. Foam insert 54 is placed in the open end 24 of the horseshoe shaped propelling charge increments 22 to retain the them inside the protector 30 during transportation vibration. A Warning label such as, "Caution!! Remove Before Firing," is molded onto the outside surface of the semi-cylindrical body 32 of the protector 30.

While the invention has been described with reference to certain preferred embodiments, numerous changes, alterations and modifications to the described embodiments are possible without departing from the spirit and scope of the invention as defined in the appended claims, and equivalents thereof.

What is claimed is:

1. An Apparatus comprising:

a mortar shell, the mortar shell including a front portion, a middle portion, a tail tube and a fin portion, the fin portion comprising a plurality of fins, the middle portion having a generally decreasing cross-section in an aft direction, the tail tube being of substantially constant cross-section:

a plurality of charge increments disposed on the tail tube, the charge increments having a generally horseshoe shape defining an opening therein, the tail tube fitting in the opening in each charge increment; and a protector for the charge increments, the protector comprising:

a semi-cylindrical body, the semi-cylindrical body arranged around a bottom and sides of the charge increments;

two generally horseshoe shaped end plates attached to a front and rear of the semi-cylindrical body, the end plates defining openings therein, the tail tube fitting in the opening in each end plate, the charge increments being disposed between the two end plates;

a wedge-shaped boom attached to the rear end plate, the wedge-shaped boom fitting between two fins on the fin portion;

a stop tab attached to a rear end of the wedge-shaped boom, the stop tab extending substantially perpendicular to a narrow side of the wedge-shaped boom to contact an end of the fin portion thereby minimizing longitudinal motion of the charge increments; and a nose cone attached at the front of the semi-cylindrical body, the nose cone defining an opening at its front end, the middle portion of the mortar shell fitting in the opening.

2. The apparatus of claim 1 wherein the protector comprises polycarbonate/acrylonitrile butydiene styrene (PC/ABS) plastic alloy.

3. The apparatus of claim 1 further comprising foam attached to an interior surface of the semi-cylindrical body.

4. The apparatus of claim 3 wherein the foam comprises two rectangular strips.

5. The apparatus of claim 3 wherein the foam comprises polyether polyurethane.

6. The apparatus of claim 1 further comprising foam attached to an interior surface of the frontend plate.

7. The apparatus of claim 6 wherein the increment insert comprises polyethylene foam.

* * * * *